US006776201B2

(12) United States Patent
Willis

(10) Patent No.: US 6,776,201 B2
(45) Date of Patent: Aug. 17, 2004

(54) ELASTIC FUNNEL

(76) Inventor: Donna Willis, P.O. Box 593, Stormville, NY (US) 12582

( * ) Notice: Subject to any disclaimer, the term of this patent is extended or adjusted under 35 U.S.C. 154(b) by 36 days.

(21) Appl. No.: 10/269,054

(22) Filed: Oct. 11, 2002

(65) Prior Publication Data

US 2004/0069373 A1 Apr. 15, 2004

(51) Int. Cl.[7] ..... B65B 1/04
(52) U.S. Cl. ..... 141/337
(58) Field of Search ..... 141/114, 331–340

(56) References Cited

U.S. PATENT DOCUMENTS

| | | | | |
|---|---|---|---|---|
| 135,391 A | | 1/1873 | Way | |
| 1,661,704 A | | 3/1928 | Osborne | |
| 2,924,253 A | | 2/1960 | Beddow | |
| 3,923,040 A | * | 12/1975 | Beach | 600/573 |
| 4,296,502 A | * | 10/1981 | Bortle | 4/144.1 |
| 4,784,184 A | * | 11/1988 | Gates | 138/109 |
| 5,133,481 A | | 7/1992 | Mayfield | |
| 6,154,891 A | | 12/2000 | Wilson | |
| 6,223,793 B1 | * | 5/2001 | Donoughe et al. | 141/338 |

* cited by examiner

*Primary Examiner*—Steven O. Douglas
(74) *Attorney, Agent, or Firm*—Richard C. Litman

(57) ABSTRACT

An elastic tube having at least one end formed as a rolled elastic ring. The opposite end of the tube may be fashioned with a rolled elastic ring or may hang free depending on the perceived usage. The tube is fabricated from a thin latex material having a stretchability of up to 1,000%. The tube is tapered from top to bottom so as to form an unobstructed, funnel-shaped passage. The wall of the tube is fluid-impervious so that liquids can flow there through without leaking. The rolled elastic end of the tube is adapted for frictional attachment to the outlet of a liquid-filled container. The other end of the tube may be frictionally attached to the inlet of a second container to be filled. Alternatively, the other end of the tube may hang freely within the second container.

2 Claims, 2 Drawing Sheets

ELASTIC FUNNEL

BACKGROUND OF THE INVENTION

1. Field of the Invention

The present invention generally relates fluid flow devices. More specifically, the instant invention is drawn to a funnel adapted to transfer liquids, especially thick liquids, from one container to another container.

2. Description of the Related Art

Around the home and sometimes in places of business, the necessity arises to transfer liquids from one container (flexible) to another container. Viscous fluids such as liquid soap, lotion, grease, ketchup, etc. are especially difficult to transfer and often require the need for a funnel if the user can remember where the funnel was stored. Conventional funnels are usually of rigid fabrication and are designed such that fluid to be transferred is poured into the top of the funnel causing the fluid to splash. Further, the very design of the funnel insures that the process will be slow and tedious causing the user to become impatient. This scenario, in turn, often results in spillage requiring clean up and loss of a portion of the fluid. An elastic, easily-stored, disposable, leak-proof, inexpensive funnel would certainly be a welcome addition to the art.

Examples of a elastic funnels are shown in U.S. Pat. No. 135,391 (Way) and U.S. Pat. No. 2,924,253 (Beddow). The funnels are fabricated from hard rubber and though elastic, still maintain a funnel shape unless distorted by external means.

U.S. Pat. No. 6,154,891 (Wilson) shows a funnel having a flexible sheath attached thereto. The funnel of the instant patent is of rigid construction and has no provision to form a seal with a container.

U.S. Pat. No. 5,133,481 (Mayfield) is drawn to a bottle with a funnel-shaped collapsible spout. The spout is integral with the bottle and is disposable therewith.

The patents considered most pertinent to the instant invention are U.S. Pat. No. 1,661,704 (Osborne) and U.S. Pat. No. 4,784,184 (Gates). Both patents are primarily concerned with water silencers and utilize elastic hoses having funnel portions adapted for attachment to the outlet of a faucet. Each funnel member terminates in relatively long, narrow cylindrical portions. It is noted that the Gates patent contemplates pouring oil from a container through the long narrow cylindrical portion.

None of the above inventions and patents, taken either singularly or in combination, is seen to disclose an elastic funnel as will be subsequently described and claimed in the instant invention.

SUMMARY OF THE INVENTION

The instant invention is an elastic tube having at least one end formed as a rolled elastic ring. The opposite end of the tube may comprise a rolled elastic ring or may hang free depending on the perceived usage. The tube is fabricated from a thin latex material having a stretchability of up to 1,000%. The tube is tapered from top to bottom so as to form an unobstructed, funnel-shaped passage. The wall of the tube is fluid-impervious so that liquids can flow therethrough without leaking. The rolled elastic end of the tube is adapted for frictional attachment to the outlet of a liquid-filled container. The other end of the tube may be frictionally attached to the inlet of a second container to be filled. Alternatively, the other end of the tube may hang freely within the second container.

As presented, two tube sizes are contemplated to fit conventional small, medium and large containers. It should be noted however, that the tube may be made in a variety of different sizes. The tubes will be manufactured in a variety of aesthetically pleasing colors.

Accordingly, it is a principal object of the invention to provide an improved funnel, which funnel enhances the transfer of viscous liquids from a first container to a second container.

It is another object of the invention to provide an improved funnel which is fabricated from stretchable latex material.

It is a further object of the invention to provide a funnel, which funnel has at least one end which may be elastically attached to a container.

Still another object of the invention is to provide a funnel, which funnel has a stretchability factor up to one thousand percent.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
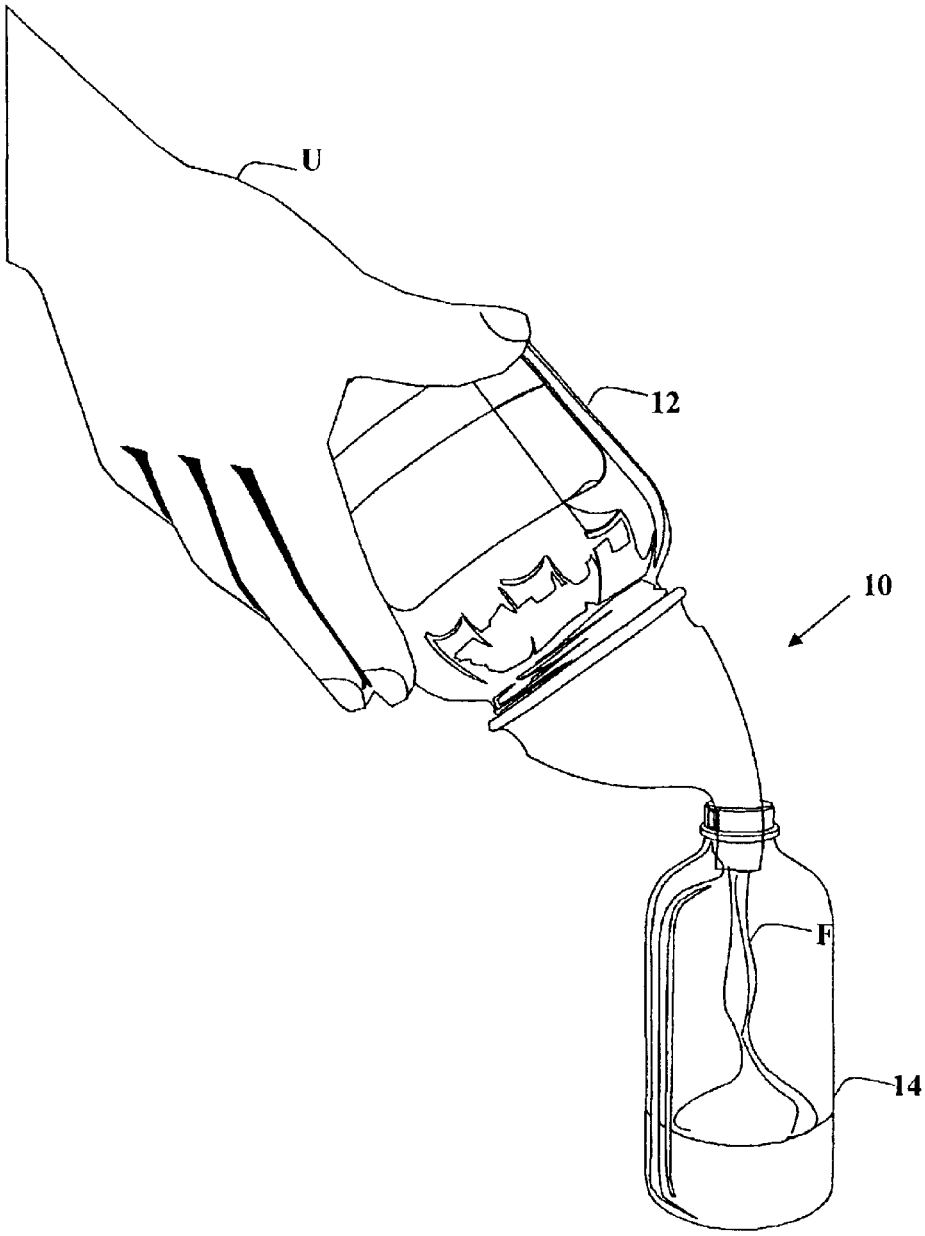
FIG. 1 is an environmental, perspective view of an elastic funnel according to the present invention.

Attention is first directed to FIG. 1 wherein the elastic funnel of the present invention is generally indicated at 10. Funnel 10 is utilized as a conduit to transfer a viscous fluid F from a first flexible container 12 into a second container 14. Application of pressure by user U on container 12 will function to pump fluid F through elastic funnel 10 into container 14.

Figure 3:
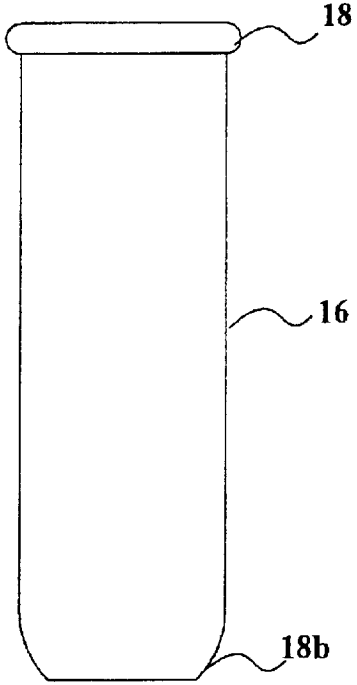
FIG. 3 is a plan view of a small-medium sized elastic funnel according to the present invention.
Figure 2:
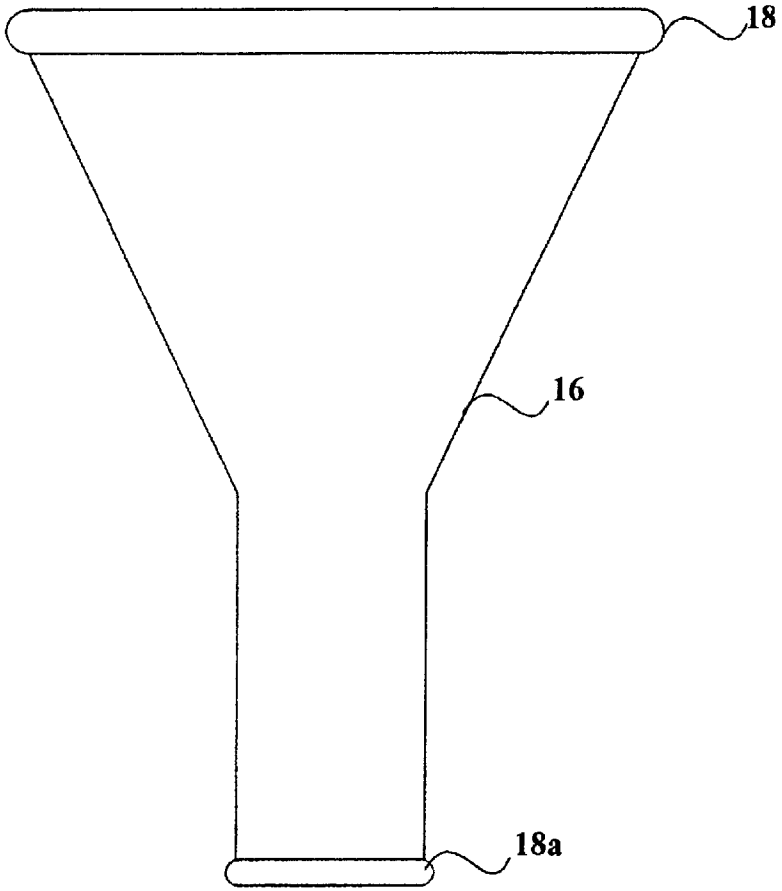
FIG. 2 is a plan view of a large-sized elastic funnel according to the present invention.

As best seen in FIGS. 2 and 3, funnel 10 comprises a tubular member 16, which member 16 is tapered from a first upper end to a second lower end. Member 16 is fabricated from durable, fluid-impervious latex material having a stretchability factor up to 1,000% and capable of being considerably stretched in all directions without breaking or tearing. The upper end of the funnel is provided with rolled elastic ring 18. Elastic ring 18 is adapted to frictionally fit around the outlet end of container 12 forming an elastic seal therewith. The lower end of the funnel may alternatively be provided with an elastic ring 18*a* (FIG. 2) or the end may be designed to hang free as shown at 18*b* (FIG. 3). This option allows the user to form a seal with the second container if necessary or to transfer the fluid as shown in FIG. 1.

As contemplated, for conventional large sized containers, the funnel has a length of five and one-half inches. The diameter of the upper end will be approximately three and one-half inches tapering to a lower end diameter of one and one-half inches. For smaller and medium-sized containers, the funnel will be approximately two and one-half inches long having an upper end diameter of one and three-sixteenths inches and tapering to a lower end diameter of one inch. As indicated above, these dimensions are preferred. The funnel could be fabricated in other dimensions to fit unconventional sized containers.

It is to be understood that the present invention is not limited to the embodiments described above, but encompasses any and all embodiments within the scope of the following claims.

I claim:

1. An elastic funnel for conducting viscous liquids from a first container into a second container, comprising;

an elongate tubular member fabricated from latex material and having a streatchability factor up to 1000%, said tubular member having a continuous fluid-impervious wall, said member having an open first end and an open second end, wherein said tubular member has a length of approximately five and one-half inches;

an unobstructed passageway extending through said tubular member from said first end to said second end;

a first elastic ring defining said first end of said tubular member, wherein said first end has a diameter of approximately three and one-half inches; and a second elastic ring defining said second end of said tubular member, wherein said second end has a diameter of approximately one and one-half inches.

2. An elastic funnel for conducting viscous liquids from a first container into a second container, comprising;

an elongate tubular member fabricated from latex material and having a streatchability factor up to 1000%, said tubular member having a continuous fluid-impervious wall, said member having an open first end and an open second end, wherein said tubular member has a length of approximately two and one-half inches;

an unobstructed passageway extending through said tubular member from said first end to said second end;

a first elastic ring defining said first end of said tubular member, wherein said first end has a diameter of approximately one and three-sixteenths; and a second elastic ring defining said second end of said tubular member, wherein said second end has a diameter of approximately one inch.

* * * * *